US005954093A

United States Patent [19]

Leonard

[11] Patent Number: 5,954,093

[45] Date of Patent: Sep. 21, 1999

[54] ROTARY SERVO VALVE

[76] Inventor: Marcus B. Leonard, 13927 Jarvis, Cypress, Tex. 77429

[21] Appl. No.: 09/149,245

[22] Filed: Sep. 8, 1998

[51] Int. Cl.[6] ..... F15B 13/04

[52] U.S. Cl. ..... 137/625.23; 137/624.13; 137/625.22; 137/625.65

[58] Field of Search ..... 137/624.13, 625.22, 137/625.23, 625.65

[56] References Cited

U.S. PATENT DOCUMENTS 4,199,007 4/1980 Holmes ..... 137/625.23 X
4,800,924 1/1989 Johnson ..... 137/625.23
5,467,800 11/1995 Sallas ..... 137/625.65

OTHER PUBLICATIONS

Elementary Steam Power Engineering, by E. McNaughton, pp. 398–401, (1933).

*Primary Examiner*—Gerald A. Michalsky
*Attorney, Agent, or Firm*—Marvin J. Marnock

[57] ABSTRACT

A rotary servo valve employs a double-edged blade-like valve gate mounted inside a sleeve having a plurality of valve ports circumferentially distributed around the sleeve at predetermined angular positions. The valve gate is reciprocable from a first to a second position to provide four-way fluid flow patterns to a fluidic actuating device.

17 Claims, 5 Drawing Sheets

ROTARY SERVO VALVE

BACKGROUND OF THE INVENTION

1. Field of the Invention

This invention is directed to a servo valve having a rotary valving mechanism characterized by low inertia and balanced forces.

2. Discussion of Related Art

Servo valves are used for throttling and directional control of fluidly-driven actuating devices such as linear actuators, seismic chirp-signal generators, motors and the like. The fluid may be pneumatic or hydraulic. The valves may be single-stage or multi-stage, depending upon the load requirements.

The function of a servo valve is to meter fluid flow from a pressure source, P, through hydraulic circuitry to a device to be driven, and thence to a sink (tank) via a return line, R. The driven device has input/output ports, A and B. Depending upon the desired direction of device operation, the servo valve selectively connects a first one of the two intake ports to P and the other port to R and then it connects the other intake port to P and the first one to R. In either position, a metering member in the valve meters the flow of hydraulic fluid at a desired flow rate in a selected direction through the input/output lines to control the direction and operational speed of the fluidly-actuated device. Such valves are known to the art as four-way valves.

For certain applications, such as for a hydraulic jack, a three-way valve is used to apply hydraulic power through line P against a piston in a closed cylinder. Ram retraction is done by causing the valve to open the cylinder to return line R, using gravity or spring loading, rather than hydraulic pressure, as the ram restoring force.

Unless otherwise stated, for convenience and by way of example but not by way of limitation, this disclosure will be explained in terms of a four-way hydraulic servo valve.

As is well known in the hydraulic art, the fluid-metering control member may be a linear spool valve or a rotary valve. In high-speed applications such as encountered with seismic swept-frequency vibrators, the actuator frequency may vary from 5 to 150 Hz over eight or ten seconds. But because of the inherent mass of the spool, the inertia of the spool creates undesirable delays and signal distortions. Further, the fluid flow rate of a spool valve may be inadequate in high-volume applications.

Rotary servo valves have been developed to attempt to ease the problem of inertia. One such valve is described in U.S. Pat. No. 5,467,800, issued Nov. 21, 1995 to John J. Sallas and assigned to the assignee of this invention. The rotary servo valve includes a valve body having a longitudinal bore therethrough, into which a sleeve is inserted. The wall of the sleeve is perforated by two groups of port openings, each group includes a plurality of sets of radially disposed ports. In each group, the central longitudinal axis of one set of ports is radially displaced from the central longitudinal axis of the other set of ports by a preselected angular displacement. At least a third set of ports in one group is in continuous fluid communication with a source of pressurized fluid; at least a third set of ports in the other group is in continuous fluid communication with a return sump. A hollow rotary control member consists of two internal chambers. Each chamber includes a number of sets of apertures that are radially disposed around the walls of the chambers, spaced-apart by a preselected angular separation. A torque motor means is furnished to rotate the control member between two opposite angular positions with respect to a null position thereby to apply power to cause a hydraulic actuator to operate in a desired manner.

The disadvantage of that valve and of others of similar design is the requirement for drilling an axial fluid passageway through the rotor. The diameter of the rotor must be large enough to contain the required cross-sectional area of the fluid conduit. But that is the very thing that must be avoided because the inertia of a tubular or cylindrical rotor increases as the 4th power of the diameter. The mass of the rotor metal on the periphery of a hollow rotor contributes more inertia than the same metallic mass of a solid rotor having a lesser diameter. Thus to reduce the inertia, the peripheral mass must be reduced along with the diameter of the rotor.

A servo valve having a solid rotor is taught by U.S. Pat. No. 4,800,924, issued Jan. 31, 1989 to D. D. Johnson. An electrical-force motor and servo-valve combination has a rotary spool directly coupled to the motor shaft without requiring a rotary-to-linear motion converter; the rotary spool is configured to have a cruciform metering section that cooperates with a flow sleeve having ports and slots configured to produce four-way flow patterns in a reduced length and volume valve package.

The '924 valve would be suitable for low flow applications at best. Further, its design offers severe manufacturing problems.

There is a need for a mechanically robust servo valve characterized by a high flow rate, by a low-inertia metering member or valve gate that is pressure-equalized to prevent structural distortion, and by ease of manufacture.

SUMMARY OF THE INVENTION

The servo valve of this invention includes a valve body with a longitudinal bore through the valve body that defines a plurality of axially spaced-apart annular chambers. The chambers are in fluid communication respectively with a fluid source, a fluid sink and the input lines of a fluidly-actuated device such as a hydraulic vibrator. A sleeve, having a wall and opposite ends, is fitted into in the bore. The wall of the sleeve is perforated by a first and a second group of valve ports. Each group of valve ports includes three sets of valve ports. Each set of valve ports is aligned axially with a corresponding annular chamber. Each set includes a plurality of valve ports which are circumferentially distributed around the wall of the sleeve at predetermined angular positions relative to a preselected reference. A double-edged flow-metering blade is rotatingly mounted inside the sleeve. The flow-metering blade defines a center land and a sealing land positioned on each of the opposite sides of the center land, axially spaced-apart therefrom. The respective lands serve to internally partition the sleeve into two closed chambers with one group of valve ports opening into each one of the chambers. Valve-gate members form longitudinal extensions of the lands along portions of the edges of the double-edged flow-metering blade. A control member is coupled to the double-edged flow-metering blade for reciprocating the flow-metering blade between a first angular position and a second angular position through a null position for selectively metering a flow of fluid to the fluidly-actuated device.

BRIEF DESCRIPTION OF THE DRAWINGS

The novel features which are believed to be characteristic of the invention, both as to organization and methods of operation, together with the objects and advantages thereof, will be better understood from the following detailed description and the drawings, some of which may not necessarily be to scale, wherein the invention is illustrated by way of example for the purpose of illustration and description only and are not intended as a definition of the limits of the invention.

DETAILED DESCRIPTION OF THE PREFERRED EMBODIMENT

Figure 1:
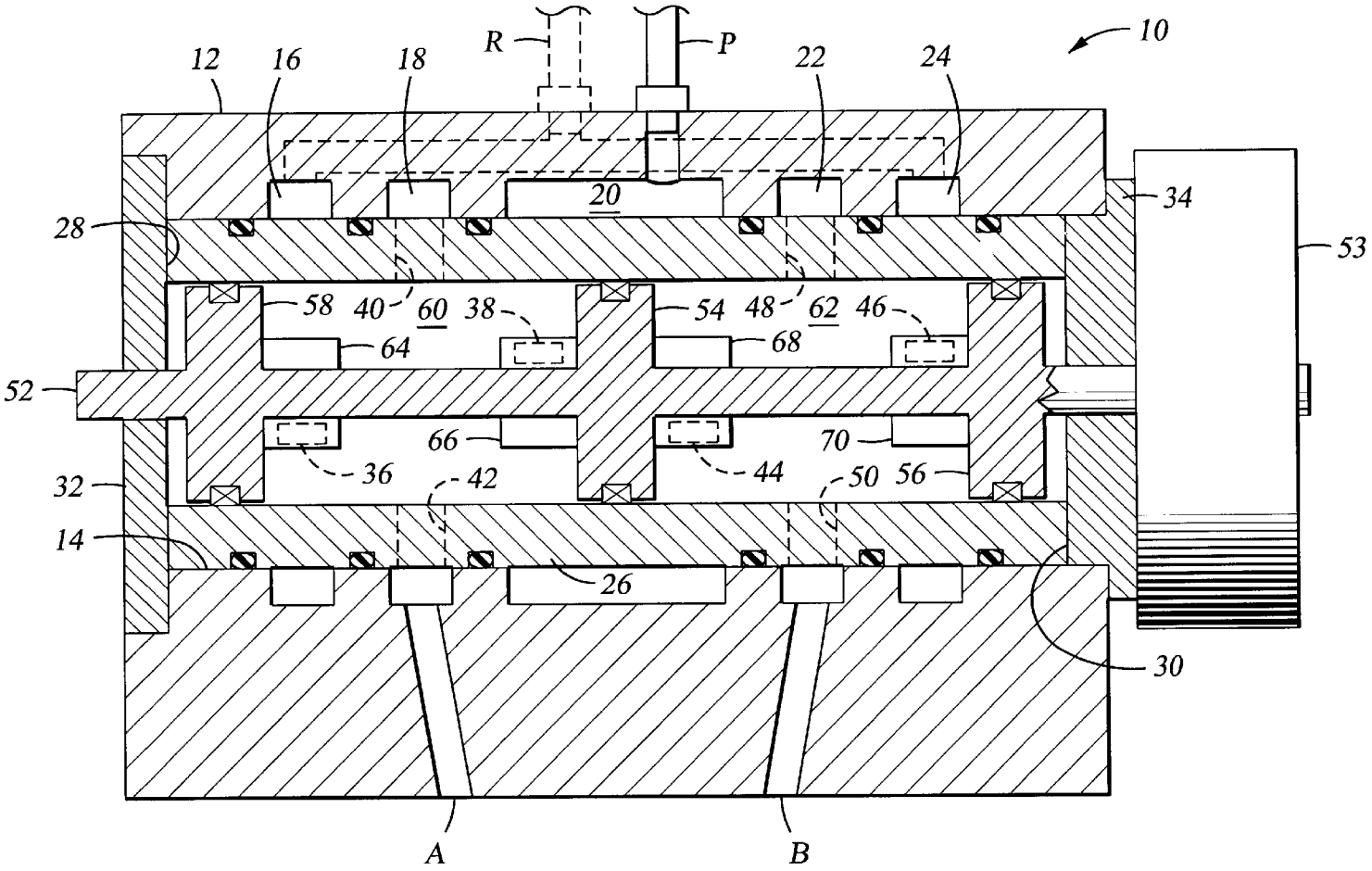
FIG. 1 is a cross-sectional schematic drawing showing the essential components of the servo valve.

FIG. 1 is an overall cross section of the assembled servo valve, generally shown as 10, of this invention. The valve, which happens to be a four-way servo valve, includes a valve body, 12, having a longitudinal bore 14. Bore 14 defines a plurality of axially spaced-apart chambers 16, 18, 20, 22, 24. Chamber 20 is in fluid communication with a source of pressurized fluid via line P. Chambers 16 and 24 are connected in parallel to a fluid sink via return line R. Chambers 18 and 22 are designed to be connected to the fluid input/output lines of a fluid-driven device via lines A and B. The fluid-driven device may be an hydraulic vibrator by way of example but not by way of limitation.

A sleeve 26 having inner and outer walls and opposite ends 28 and 30 is mounted in the longitudinal bore 14 and is held in place by end caps such as 32 and 34 which may be secured to body 12 by bolts (not shown). The sleeve 26 is perforated by two groups of valve ports 36–42 and 44–50 respectively. Each group is comprised of a first, a second and a third set of valve ports, each set including a plurality of valve ports that are circumferentially distributed around the wall of the sleeve 26 at predetermined angular positions to be discussed in more detail in connection with FIGS. 2–6.

The sets of valve ports are axially spaced-apart. Each set is aligned with, and opens into, a corresponding annular chamber. For example, valve ports 40 and 42 are aligned with annular chamber 18, port 36 is aligned with chamber 16 and in like manner for the remaining ports and chambers. Thus, fluid flow can be established between the interior of sleeve 26, and a selected annular chamber in valve body 12.

Figure 9:
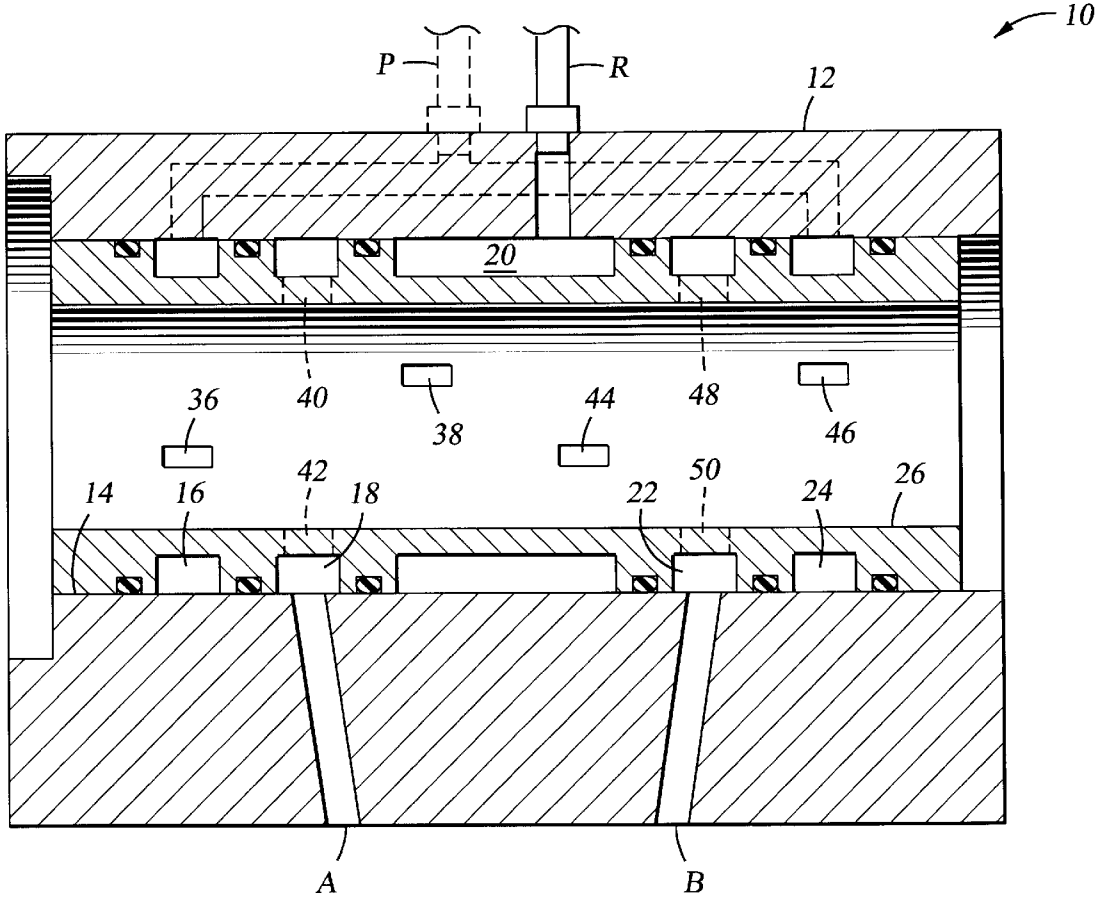
FIG. 9 is an alternate arrangement of the annular chambers of FIG. 1.

It should be recognized that sleeve 26 may be made somewhat thicker and that grooves forming the annular chambers could be machined into the outer wall of the sleeve 26 itself as shown schematically in FIG. 9, instead of in the servo-valve body 12 (for clarity, many of the details of FIG. 1 have been left out in FIG. 9, such as the flow-metering blade). Thus, the assembly including the valve body in combination with the sleeve define a plurality of spaced-apart annular chambers.

A valve gate in the form of a flat double-edged flow-metering blade 52 is rotatably mounted inside sleeve 26. A control means, 53, of any desired type such as a stepping motor or a manual control is coupled to the flow-metering blade for reciprocating the blade between a first angular position and a second angular position through a null position. The flow-metering blade has a center land 54 and sealing lands 56 and 58 which partition the internal volume of sleeve 26 into two closed chambers 60 and 62. Sealing lands are 56 and 58 are positioned on opposite sides of the center land and axially spaced-apart therefrom.

Longitudinal arcuate flanges form the valve-gate members 64, 66, 68, 70 that perform the actual gating capability of flow-metering blade 52. The valve-gate members extend away from the lands along portions of the edges of the flow-metering blade. The valve-gate members meter fluid flow through selected valve ports when the flow-metering blade is reciprocated to a first, a second or a null position. In a first angular position, the flow-metering blade opens one of the intake lines such as A to Pressure and vents the other intake line such as B to Return. In a second angular position, the reverse function takes place.

The description of FIG. 1 is a generalized picture of the structure of the servo valve as a whole. As a matter of interest, the four-way valve shown in FIG. 1 could be converted to a three-way valve simply by blocking-off intake port B.

Figure 2A:
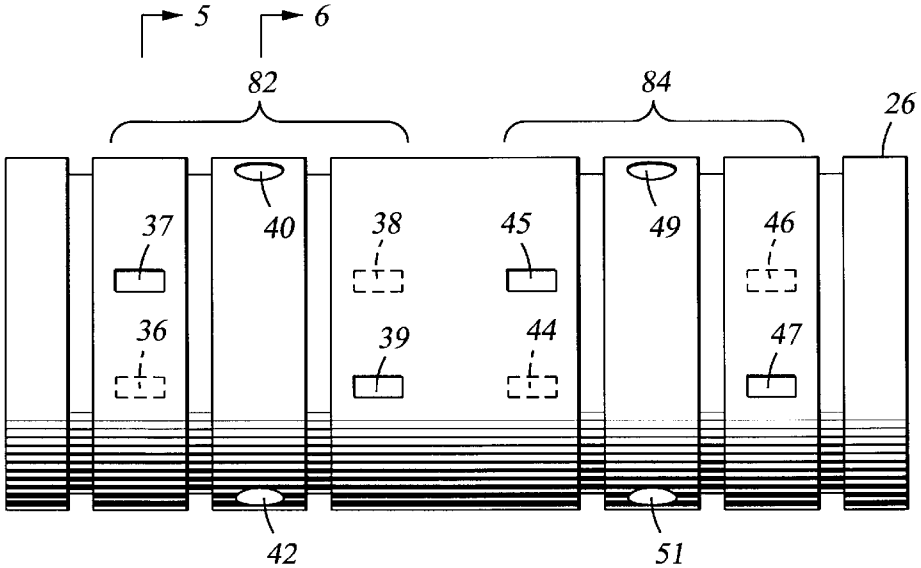
FIGS. 2A and 2B are an exploded side view of the sleeve and the double-edged flow-metering blade.
Figure 5:
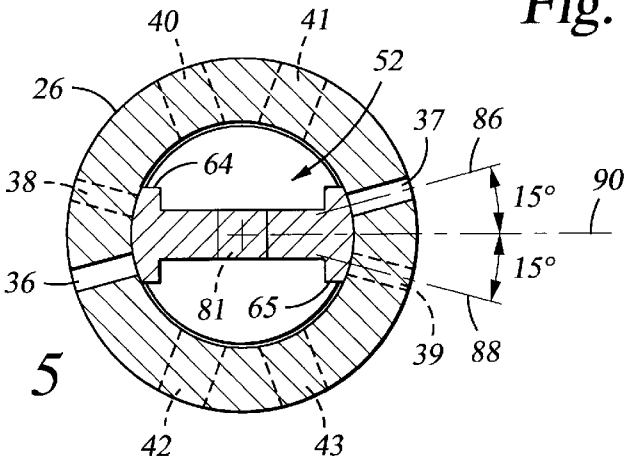
FIG. 5 is a cross section along line 5—5 of FIG. 2 through the sleeve with the flow-metering blade mounted inside the sleeve.
Figure 6:
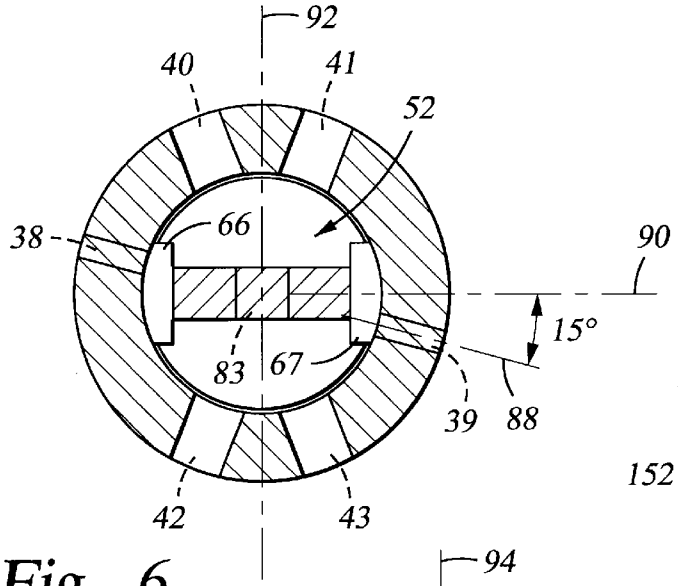
FIG. 6 is a cross section along line 6—6 of FIG. 2 through the sleeves with the flow-metering blade mounted inside the sleeve.

Please refer now to FIGS. 2A–6 for a more specific description of the key parts of this invention. FIGS. 2A and 2B taken together form an exploded side view of sleeve 26 and flow-metering blade 52. In comparing FIGS. 1, 2A and 2B, remember that FIG. 1 is a cross section whereas FIGS. 2A and 2B are side views. FIG. 5 and 6 are cross sections along lines 5—5 and 6—6 of FIG. 2A but with the flow-metering blade 52 in place inside sleeve 26.

Refer now to FIG. 2A. As before stated, the wall of the sleeve is perforated by two groups of valve ports, 82 and 84. Each group contains three sets of valve ports. Any two sets may be designated as metering ports and the other set as free-flow, always-open ports.

By way of example but not by way of limitation, counting from the left end of the sleeve and referring to FIGS. 2A and 5, two sets of ports are metering ports such as the first and third sets of a group such as 82. Each set includes at least two valve ports that pierce the wall of the sleeve 26 on diametrically opposite sides. A center line 86 joining the valve ports 36, 37 of the first set is rotated relative to a center line 88 joining the valve ports of the third set, 38, 39 by a first angle of 15° as measured from opposite sides of a null reference position 90. The free-flow valve-port set (FIGS. 2A and 6), such as the second set of ports, includes at least two and preferably four, always-open valve ports, such as 40, 41, 42, 43, clustered about a reference line, 92, that is orthogonal to the null reference 90. The valve ports of group 84 are configured similarly. Sleeve 26, includes a plurality of O-ring slots such as 96, for receiving O-rings (not shown in FIG. 2A) in whatever number is required in accordance with conventional engineering practice.

Figure 2B:
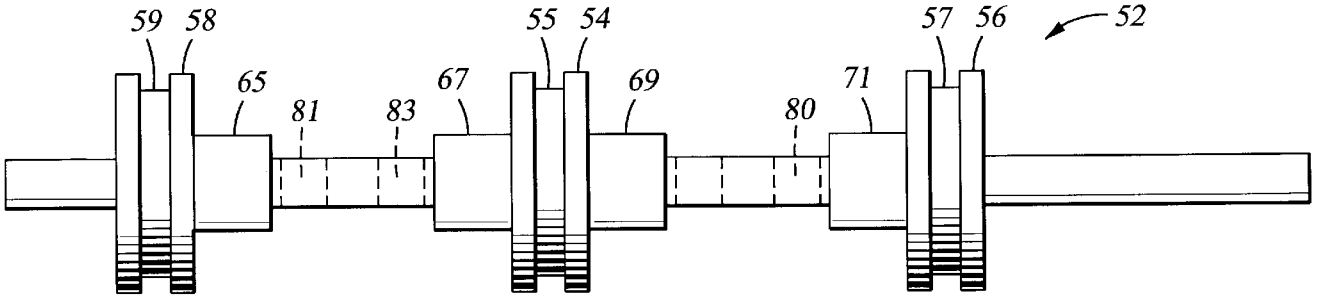

Refer now to FIGS. 2B–4. FIG. 2B is a side view of flow-metering blade or valve gate 52 (hereinafter "blade" for brevity) which consists of a center land 54 and end lands 56 and 58 on opposite sides of center land 54. The respective lands are each provided with one or more bearing races 55, 57 and 59 for receiving pin or ball bearings (not shown in FIG. 3) to minimize friction between blade 52 and the inner wall of sleeve 26.

Figure 3:
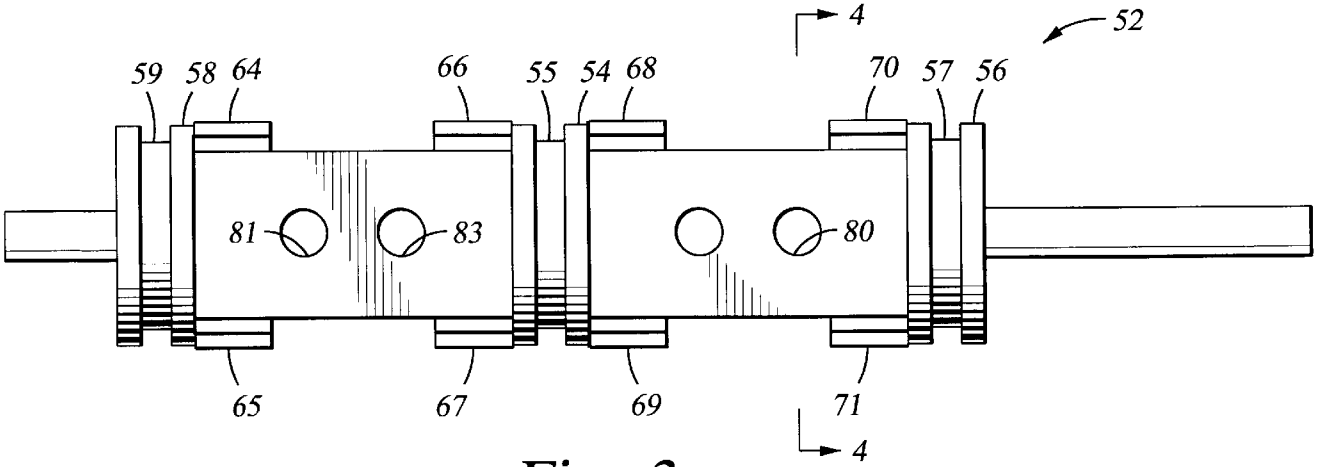
FIG. 3 is a top view of the flow-metering blade.

When blade 52 is rotatingly mounted inside sleeve 26, the lands partition sleeve 26 into two internal closed compartments, 60 and 62 (FIG. 1), each of which services one of the two groups of valve ports. Arcuate valve-gate members such as 65, 67, 69, 71 extend lengthwise along portions of the edges of blade 52 forming extensions of the center and end lands as shown in FIGS. 2B and 3. The valve-gate members on blade 52 serve to control fluid flow through the corresponding valve ports 36–39 and 44–47. Blade 52 is manufactured such that the clearance between the lands and the inner wall of sleeve 26 minimizes fluid leakage and eliminates the need for O-rings with their inherent drag.

Figure 4:
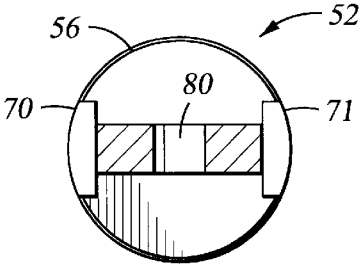
FIG. 4 cross-section of the flow-metering blade of FIG. 3 along line 4—4.

FIG. 3 is a top view of blade 52. Shown are the center and end lands as well as valve-gate members 64, 66, 68 and 70 that were hidden from view in FIG. 2B. Orifices such as 80, 81, 83 may be drilled through the flat side of the blade to provide free fluid circulation around both sides of the blade to assure pressure equalization. FIG. 4 is a cross section along line 4—4 of FIG. 3, looking towards end land 56, showing the configuration of the valve gate members such as 70 and 71 relative to blade 52 and pressure equalization orifice 80. The flat portions of blade 52 may be hollowed out a bit, provided structural integrity is not compromised, to reduce the mass and to provide a larger fluid flow volume.

For the best mode of operation, assume that blade 52 has been inserted inside sleeve 26 and initially rotated to the null position 90 as shown in FIGS. 5 and 6. Turned to that position, for group 82 the valve-gate members 64–67 close metering ports 36–39 cutting off flow of fluid to the fluid-operated device whose input lines A and B are coupled to free-flow always-open ports 40–43. Similarly for the metering- and free-flow ports associated with group 84, namely 44–47 and 49–51.

Let the flow-metering blade be turned 15° counter-clockwise to a first position. For valve-port group 82, metering ports 36 and 37 are closed while metering ports 38 and 39 are opened. Fluid flow from a pressure source P is directed through metering ports 38, 39 to metering ports 40–43 to input line A of a fluid-operated device connected thereto. At the same time, as can be seen from FIG. 2A, with respect to the group 84 valve ports, return line R is opened to vent input line B through to a fluid sink. When the flow-metering blade is turned to a second position such as 15° clockwise, the roles of lines P and R relative to A and B are reversed.

As can be seen from the drawings, pressurized fluid flows freely around and over the flow-metering blade to provide complete pressure equalization. The orifices such as 80 provide additional equalization capability. Because of the pressure equalization, valve gate members of flow-metering blade 52 are not subjected to structural stress-distortion due to internal differential pressures. It can be made much less massive, thus achieving the desideratum of reducing inertial forces during operation.

Figure 7:
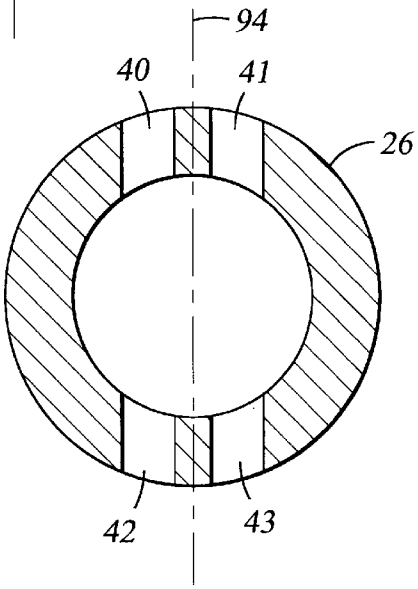
FIG. 7 is an illustration of an alternate alignment direction of the axes of the valve ports.

In the drawings, such as FIGS. 5 and 6, the valve ports are shown drilled through the sleeve, their flow-axes being aligned along radial fan out lines like the spokes of a wheel. Alternatively, the valve ports such as 40–43 could be drilled through the sleeve with their flow-axes aligned along a line parallel to, but laterally displaced from a diametric reference line 94 as shown in FIG. 7. The purpose would be to provide a more compact grouping of the valve ports as well as certain manufacturing economies.

Figure 10:
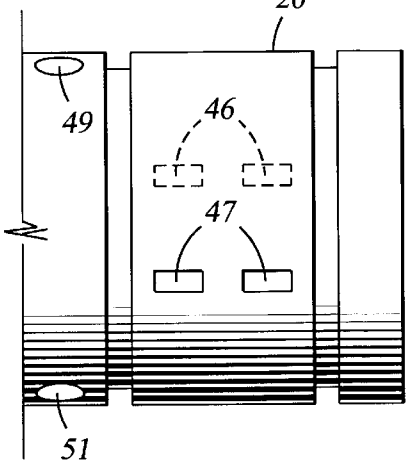
FIG. 10 is an alternate arrangement of the valve-port apertures.

The individual valve ports must have a cross-sectional area sufficient to provide the required hydraulic-fluid flow rate. Because the angular circumferential width of a valve port is limited, an increase in cross-sectional area requires an extension of the length of the valve-port opening. But a long, narrow valve-port opening is structurally unstable. Therefore, the individual valve ports of a set such as 46 and 47 may be configured as an array of two or more openings distributed side-by-side parallel to the sleeve 26 as shown in the partial sectional drawing of FIG. 10. The cumulative cross-sectional area of each array of valve ports in a set is selected to be of a size adequate for providing the required fluid-flow rate.

Figure 8:
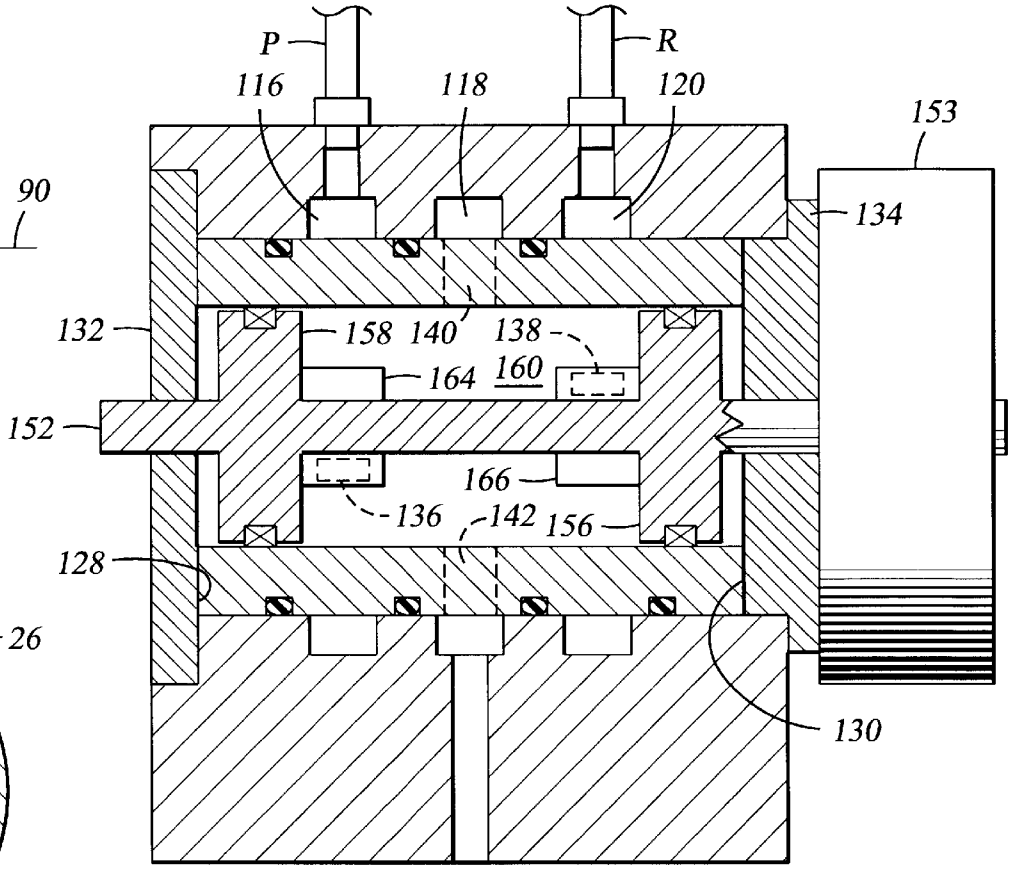
FIG. 8 is a schematic cross section of a three-way servo valve.

As earlier stated, the four-way valve of this invention may be converted to a three-way valve by simply blocking-off one of the two input-port lines such as line B. However, a dedicated three-way valve could be built to order. Refer now to FIG. 8. Reference numbers are identical to those of FIG. 1–6 except that those original numbers are augmented by 100 for purposes of FIG. 8.

The difference between the servo valve of FIG. 1 and the servo valve of FIG. 8 is the flow-metering blade 152 which now defines a single closed chamber, 160, in sleeve 126. The group-84 ports of FIG. 1 are not present and the conduit to input B does not exist. Otherwise the valve of FIG. 8 operates exactly like the valve of FIG. 1. Therefore, there should be no need for a detailed description of FIG. 8 which will not be presented to avoid prolixity.

This invention has been described with a certain degree of specificity by way of example but not by way of limitation. Those skilled in the art will devise obvious variations to the examples given herein but which will fall within the scope of this invention which is limited only by the appended claims.

What is claimed is:

1. A servo valve including a valve body, a bore in said valve body, the bore defining a plurality of axially spaced-apart annular chambers for fluid communication respectively, with a fluid source, a fluid sink and the fluid input/output lines of a fluidly-actuated device, comprising:

a sleeve, having a wall and opposite ends, mounted in the bore, the sleeve wall being pierced by a first and a second group of valve ports, each group including three sets of valve ports, each set of valve ports being aligned axially with a corresponding annular chamber, within each set there being a plurality of valve ports that are circumferentially distributed around the wall of the sleeve at predetermined angular positions relative to a preselected reference;

a double-edged flow-metering blade that is rotatingly mounted inside the sleeve, the flow-metering blade defining a center land and two sealing lands on opposites sides of the center land and spaced-apart therefrom, for internally partitioning the sleeve into two closed chambers, one group of valve ports opening into each chamber;

a control member coupled to the flow-metering blade for reciprocating the flow-metering blade between a first angular position and a second angular position through a null reference position for metering a flow of fluid in a selected direction at a desired rate through the input/output lines of said fluidly-actuated device.

2. The servo valve as defined by claim 1, comprising:

longitudinal arcuate valve-gate members formed along a portion of the edges of said flow-metering blade; and orifices in said flow-metering blade for pressure equalization.

3. The servo valve as defined by claim 2, wherein:

each group of valve ports includes three sets of valve ports, any two sets of valve ports being designated as metering ports, a third set being designated as free-flow, always-open ports;

the metering valve ports each include two valve ports that pierce the wall of the sleeve on diametrically opposite sides thereof;

a center line joining the valve ports of one of the sets of metering ports is rotated relative to a center line joining the ports of the other set by a first preselected angle as measured on opposite sides of said null reference position;

the valve ports of the free-flow set include at least one pair of always-open ports aligned along a reference line that is substantially orthogonal to the null reference position.

4. The servo valve as defined by claim 3, wherein:

said first preselected angle is 15°.

5. The servo valve as defined by claim 1 wherein said sleeve has a central longitudinal axis and each said valve-port is defined by a passage which extends through the sleeve wall in a radial direction with respect to said sleeve axis.

6. The servo valve as defined by claim 1 wherein each said valve port is defined by a passage which extends through the wall of said sleeve in a direction parallel to a diametric reference line of said sleeve.

7. A servo valve for metering the flow of fluid through a fluid-actuated device in a selected direction, the valve including a valve body, a longitudinal bore in said valve body, the bore defining a plurality of axially spaced-apart annular chambers that are in fluid communication respectively, with a fluid source, a fluid sink and at least one fluid input line of the fluid-actuated device, comprising:

a sleeve fitted in the bore, the sleeve including a plurality of sets of valve ports, each set of valve ports being aligned axially with a corresponding annular chamber, within each set there being a plurality of valve ports that are circumferentially distributed around the sleeve at predetermined angular positions relative to a reference line;

a flow-metering blade that is rotatingly mounted inside the sleeve, the flow-metering blade defining two end lands for internally sealing the opposite ends of the sleeve to define an internal closed chamber;

a control member coupled to the flow-metering blade for reciprocating the flow-metering blade between a first angular position and a second angular position relative to a null reference line.

8. The servo valve as defined by claim 7, comprising:

a first set of valve ports, a second set of valve ports and a third set of valve ports;

the first and third sets of valve ports each include two valve ports positioned in diametrically opposite sides of the sleeve;

a line joining the valve ports of the first set is rotated relative to a line joining the valve ports of the third set by a first preselected angle measured on opposite sides of said null reference line;

the second set includes at least one pair of ports, one valve port being positioned in the sleeve diametrically opposite the other valve port of the pair, a line joining the valve ports of the at least one pair of ports being aligned substantially orthogonally with respect to the null reference line.

9. The servo valve as defined by claim 8, wherein:

The first preselected angle is 15°.

10. The servo valve as defined by claim 8, wherein:

said second set of valve ports includes two pairs of valve ports, one valve port of each pair being diametrically opposite the other valve port of each pair, lines joining the valve ports of each pair being rotated with respect to each other by a second preselected angle.

11. The servo valve as defined by claim 10, comprising:

longitudinal arcuate valve-gate members formed along portions of the edges of the flow-metering blade;

a plurality of pressure-equalization orifices in the flat portion of the flow metering blade;

said end lands each including at least one bearing race.

12. A servo valve for metering the flow of fluid to a fluid-actuated device, the valve including a valve body, a longitudinal bore in said valve body, the longitudinal bore defining a plurality of axially spaced-apart annular chambers for fluid communication respectively, with a fluid source, a fluid sink and fluid input/output lines of the fluid-actuated device, comprising:

a sleeve fitted in the bore, the sleeve including a first and a second group of valve ports, each group of valve ports including a first set, a second set and a third set of valve ports, each set of valve ports being aligned axially with a corresponding annular chamber, within each set there being a plurality of valve ports that are circumferentially distributed around the sleeve at predetermined angular positions relative to a reference;

a flow-metering blade that is rotatingly mounted inside the sleeve, the flow-metering blade defining a center land and two end lands for internally partitioning the sleeve into two closed chambers, one group of valve ports opening into each chamber;

longitudinal arcuate valve-gate members secured to portions of the edges of the flow-metering blade and extending away from the lands a control member coupled to the flow-metering blade for rotating the flow-metering blade between:

i) a first angular position for metering fluid through said first set of valve ports of said first group and the third set of valve ports in said second group, and ii) a second angular position for metering fluid through said third set of valve ports of said first group and the first set of valve ports of said second group, and iii) said first and second positions being rotated by a first preselected angle on opposite sides of a null position, and iv) the second set of valve ports of both groups being always open.

13. The servo valve as defined by claim 12, wherein:

said first preselected angle is 15°.

14. A servo valve for metering the flow of fluid to a fluid-actuated device, the valve including a valve body having longitudinal bore, comprising:

a sleeve having inner and outer walls fitted in the bore, a plurality of axially spaced-apart grooves formed around the outer wall of the sleeve, the grooves in combination with the valve body forming a plurality of annular chambers for fluid communication with a fluid source, a fluid sink and the input/output lines of a fluidly-actuated device, the sleeve further including a plurality of sets of valve-port arrays, each set of valve-port arrays being aligned axially with a corresponding annular chamber, within each set there being a plurality of valve port arrays that are circumferentially distributed around the sleeve at predetermined angular positions relative to a reference;

a flow-metering blade that is rotatingly mounted inside the sleeve, the flow-metering blade defining a center land and two end lands for internally partitioning the sleeve to define two internal closed chambers;

a control member coupled to the flow-metering blade for reciprocating the flow-metering blade between a first angular position and a second angular position relative to a null reference line.

15. The servo valve as defined by claim 14, wherein:

the valve port arrays of each set include at least two valve ports in linear side-by-side relationship.

16. A servo valve for metering the flow of fluid to a fluid-actuated device, the valve including a valve body having a longitudinal bore, comprising:

a sleeve having inner and outer walls fitted in the bore, a plurality of axially-spaced-apart grooves formed around the outer wall of the sleeve, the grooves in combination with the valve body forming a plurality of annular chambers for fluid communication with a fluid source, a fluid sink and the input/output lines of a fluidly-actuated device;

the sleeve further including a three sets of valve port arrays, each set of valve-port arrays being aligned axially with a corresponding annular chamber, within each set there being a plurality of valve port arrays that are circumferentially distributed around the sleeve at predetermined angular positions relative to a reference;

a flow-metering blade that is rotatingly mounted inside the sleeve, the flow-metering blade defining two end lands for internally sealing the opposite ends of the sleeve to define an internal closed chamber;

a control member coupled to the flow-metering blade for reciprocating the flow-metering blade between a first angular position and a second angular position relative to a null reference line.

17. The servo valve as defined by claim 16, wherein:

any two sets of valve port arrays are designated as metering ports, the other set being designated as a free-flow, always-open port;

each metering port includes two valve-port arrays that pierce the wall of the sleeve on diametrically opposite sides thereof;

a center line joining the valve-port arrays of one metering port is rotated relative to a center line joining the valve-port arrays of the other metering port by a first preselected angle as measured on opposite sides of the null reference position;

the free-flow port includes at least one pair of always-open valve-port arrays piercing diametrically opposite sides of the sleeve wall aligned along a reference line that is substantially orthogonal to the null reference position.

* * * * *